US009638457B2

(12) United States Patent
Resch

(10) Patent No.: US 9,638,457 B2
(45) Date of Patent: May 2, 2017

(54) COOLING UNIT FOR CHILLED, IN PARTICULAR FROZEN, GOODS

(75) Inventor: Reinhold Resch, St. Peter (AT)

(73) Assignee: AHT Cooling Systems GmbH, Rottenmann (AT)

( * ) Notice: Subject to any disclaimer, the term of this patent is extended or adjusted under 35 U.S.C. 154(b) by 0 days.

(21) Appl. No.: 14/240,042

(22) PCT Filed: Aug. 24, 2012

(86) PCT No.: PCT/AT2012/050117
§ 371 (c)(1),
(2), (4) Date: Mar. 13, 2014

(87) PCT Pub. No.: WO2013/026079
PCT Pub. Date: Feb. 28, 2013

(65) Prior Publication Data

US 2014/0184049 A1 Jul. 3, 2014

(30) Foreign Application Priority Data

Aug. 24, 2011 (AT) ..... A 1215/2011

(51) Int. Cl.
*A47F 3/04* (2006.01)
*F25D 23/06* (2006.01)
*F25D 23/02* (2006.01)

(52) U.S. Cl.
CPC ..... *F25D 23/067* (2013.01); *A47F 3/0413* (2013.01); *A47F 3/0426* (2013.01);
(Continued)

(58) Field of Classification Search
CPC .... F25D 23/067; F25D 23/021; F25D 23/026; F25D 2327/00; A47F 3/0413; A47F 3/0426; A47F 3/043
(Continued)

(56) References Cited

U.S. PATENT DOCUMENTS 1,134,540 A * 4/1915 Kress ..... 217/62
2,142,469 A * 1/1939 Williamson et al. ..... 312/295
(Continued)

FOREIGN PATENT DOCUMENTS

DE 84 01 106 U1 4/1984
DE 3416685 A1 11/1985
(Continued)

OTHER PUBLICATIONS

International Search Report of PCT/AT2012/050117, mailed Aug. 29, 2013.

*Primary Examiner* — Daniel J Troy
*Assistant Examiner* — Timothy M Ayres
(74) *Attorney, Agent, or Firm* — Collard & Roe, P.C.

(57) ABSTRACT

The invention relates to a cooling unit (1) for chilled, in particular frozen, goods, comprising a cooling chamber (2), a housing wall (3) that at least partially delimits the cooling chamber (2), a carrier (8) that bridges the cooling chamber (2) at least in some regions and has a covering (14) and a support profile (15) for absorbing bending stresses, which profile is at least partially covered by the covering (14), and at least one sliding cover (4, 5, 6, 7), by means of which the cooling chamber (2) can be at least partially closed and which is mounted in a slidable manner on the covering (14) of the carrier (8) and on the housing wall (3) by way of linear guides (9, 10, 11) of the cooling unit (1). In order to provide a stable and user-friendly cooling unit (1), the support profile (15) runs at least partially beneath the linear guide (10, 11).

19 Claims, 3 Drawing Sheets

(52) U.S. Cl.
CPC ..... *F25D 23/021* (2013.01); *F25D 23/026* (2013.01); *F25D 2327/00* (2013.01)

(58) Field of Classification Search
USPC ..... 312/116, 295
See application file for complete search history.

(56) References Cited

U.S. PATENT DOCUMENTS

| | | | | | |
|---|---|---|---|---|---|
| 2,276,635 | A | * | 3/1942 | Weber | 220/349 |
| 2,562,609 | A | * | 7/1951 | Frohnapel | 220/215 |
| 2,585,645 | A | * | 2/1952 | Freitag | 160/206 |
| 2,793,925 | A | | 5/1957 | Rosen | |
| 3,208,809 | A | | 9/1965 | Quimper | |
| 3,584,417 | A | * | 6/1971 | Gatton et al. | 49/404 |
| 3,729,243 | A | | 4/1973 | Musgrave et al. | |
| 4,330,310 | A | * | 5/1982 | Tate et al. | 62/275 |
| 4,602,827 | A | | 7/1986 | Casanova | |
| 4,852,303 | A | * | 8/1989 | Rolek | 49/504 |
| 4,941,289 | A | * | 7/1990 | Rolek | 49/504 |
| 6,260,694 | B1 | | 7/2001 | Sasahara | |
| 2013/0285517 | A1 | * | 10/2013 | Wach et al. | 312/114 |
| 2014/0109607 | A1 | * | 4/2014 | Buehning et al. | 62/265 |

FOREIGN PATENT DOCUMENTS

| | | |
|---|---|---|
| DE | 198 51 225 A1 | 5/1999 |
| JP | H10 89838 A | 4/1998 |

* cited by examiner

COOLING UNIT FOR CHILLED, IN PARTICULAR FROZEN, GOODS

CROSS REFERENCE TO RELATED APPLICATIONS

This application is the National Stage of PCT/AT2012/050117filed on Aug. 24, 2012, which claims priority under 35 U.S.C. §119 of Austrian Application No. A 1215/2011 filed on Aug. 24, 2011, the disclosure of which is incorporated by reference. The international application under PCT article 21(2) was not published in English.

TECHNICAL FIELD

The invention relates to a refrigeration appliance for refrigerated goods, particularly frozen goods, having a refrigeration space, having a housing wall that delimits the refrigeration space at least in part, having a support that bridges the refrigeration space at least in certain regions, which support has a casing and a support profile covered by the casing, at least in part, to absorb bending stresses, and having at least one sliding cover by means of which the refrigeration space can be closed off, at least in part, and which is mounted so as to be displaceable on the casing of the support and on the housing wall, by way of linear guides of the refrigeration appliance.

STATE OF THE ART

Refrigeration appliances are known from the state of the art (DE8401106U1, DE3416685A1, J10089838A), which have a support that spans the refrigeration space, in order to be able to support sliding covers by way of this support. Furthermore, it is known from the state of the art to configure such a support that spans the refrigeration space from a metal profile pushed into a plastic profile. The plastic profile additionally forms sliding surfaces for the sliding covers. It is true that such a design can be constructed sufficiently for static stresses, but dynamic stresses that occur from leaning on the sliding covers, for example, can lead to distortions and actually to mechanical failure of the support. Such designs therefore cannot ensure an operationally reliable refrigeration appliance that is suitable for commercial use.

PRESENTATION OF THE INVENTION

The invention has therefore set itself the task of improving a refrigeration appliance of the type described initially with a simple design, in such a manner that it can robustly withstand even comparatively great dynamic stresses on the sliding covers. The invention accomplishes the stated task in that the support profile runs underneath the linear guide, at least in part.

If the support profile runs underneath the linear guide, at least in part, the linear guide can be constructed, in simple manner, so that it has the greatest mechanical strength, without having to take other or additional measures for mechanical fixation of the guide of the sliding covers. In contrast to the state of the art, a robust and stable refrigeration appliance can therefore be created, which robustly counteracts not only dynamic stresses such as those that can occur as the result of activation of the sliding covers during opening and closing of the refrigeration space, but also those due to impacts or due to persons leaning on the sliding covers, for example. The support profile according to the invention can therefore demonstrate a sufficiently great resistance moment to prevent bending of the running surfaces, thereby making it possible to prevent the sliding covers from breaking and to create a robust refrigeration appliance.

Thermal bridges of cold can be reduced in simple manner, in that at least one gap, which increases in size at least in certain regions, is provided in the region of the linear guide, between the casing and the support profile. Specifically because the support profile runs underneath the linear guide, the risk can occur that the linear guide forms thermal poles of cold in the connection region of the sliding cover to the support. Increased heat insulation can be achieved in this manner, by means of this gap, which particularly increases in size underneath the linear guide, in the direction of the goods space, toward the connection region of the sliding cover. Improved thermal separation of the support from the casing can be created with this region, filled with air or another heat-insulating or cold-insulating medium. This can be particularly advantageous if the casing has a lower heat conductivity than the support profile, which can result from the fact that the casing is a plastic material and the support profile is a metal material. Formation of icing, accumulation of melted water, etc., can thereby be prevented in elegant manner.

The aforementioned advantages particularly stand out if the gap increases in size in such a manner that improved thermal separation of the support from the casing is created, in order to prevent thermal poles of cold in the connection region of the sliding cover to the support.

Simple installation and maintenance conditions can result if the casing that surrounds the support profile, at least in part, has at least two profile parts that can be connected with one another. Thus, for example, a broken or worn casing can be removed from a support profile quickly and easily, and a new casing can be connected with the support profile, without the entire support having to be replaced for this purpose. Thereby significant cost advantages can also result, using the refrigeration appliance according to the invention.

If the profile parts of the casing are connected with one another with shape fit, by way of at least one snap connection that particularly has a snap hook, then the design conditions can be simplified even further. Furthermore, snap connections are comparatively less sensitive to production tolerances, and this can lead to simple production and installation conditions.

A shape-fit connection that has a simple design and also allows comparatively simple servicing of the refrigeration appliance can be created if the casing is connected with the support profile by way of at least one snap connection, with shape fit. In this way, replacement of the casing, for example, can be facilitated, and this can particularly be necessary if the parts of the linear guide assigned to the casing demonstrate wear phenomena.

If the support profile forms a slide surface for the resilient hook of the snap connection of the casing, which surface runs toward the snap connection, the hook can be brought into its engagement position for a shape-fit connection during installation of the support profile, with uniform stress. In this way, the risk of material fracture during assembly of the refrigeration appliance can be reduced, and this can further simplify the installation and maintenance conditions and thereby lead to cost advantages.

The casing can also form an anti-glare shield for a light attached to the support, in order to thereby be able to ensure indirect lighting of the refrigeration space by means of a light attached to the support. It is possible to provide an anti-glare shield that reflects light, at least in part, which improves the illumination or lighting of the refrigeration space of a refrigeration appliance. Energy-saving or particularly LED lights can preferably be provided for illumination of a refrigeration space; these can be reliably used in a cold or cool environment and produce only little waste heat during operation. Furthermore, the anti-glare shield can be shaped and positioned with regard to the lights, in such a manner that it can also act as protection for the lights. In this manner, the lights can be protected against mechanical damage, for example, as can occur when cleaning the refrigeration space or placing parts/goods in it, or when removing goods from the refrigeration space.

Design simplicity can result if the upper profile part of the casing forms the anti-glare shield, and the lower profile part of the casing forms the holder for the lights. In this manner, it can be made possible, among other things, that replacement of the upper profile part of the casing, for example due to damage, is possible without also having to release the lower profile part, which holds the lights, from the support profile. In this manner, a particularly maintenance-friendly refrigeration appliance can be created.

Furthermore, sliding covers can be provided in the longitudinal direction of the support, on both sides, and this can be made possible in simple manner, for example, by means of a symmetrical structure of the support. Advantages of the refrigeration appliance according to the invention, with regard to its usability and its operability, can result from this. For example, a refrigeration appliance can be designed, using such a support, the sliding covers of which close off only a part of the total width of the opening into the refrigeration space, because the broad side of this opening is interrupted by the support, on which sliding covers lie on both sides. Furthermore, the refrigeration space of a refrigeration appliance can be accessible from both longitudinal sides, without having to open the opening into the refrigeration space in its entire width, using sliding covers—something that can bring about advantages with regard to the operating costs of the refrigeration appliance, among other things. Furthermore, this accessibility from both sides can be used for store personnel to fill the refrigeration space with goods, but at the same time to allow customers the possibility of taking goods out of the refrigeration space. Furthermore, a pinch point hazard with opposite operation of the sliding covers can be reduced with this separation device. A refrigeration appliance that is particularly user-friendly and safe to operate can be created in this way.

The support can form installation connectors in the region between the sliding covers on both sides, and, in particular, project beyond the sliding covers on both sides, in order to thereby be able to attach price signs or other informational signs on the refrigeration appliance. Furthermore, a separation device can be attached to this connector, in order to prevent accessibility of the refrigeration space from the opposite longitudinal side of the refrigeration appliance, in each instance. The overloads on the support that could occur during such undesirable operation can thereby be prevented in simple manner.

The design simplicity can be further improved if the linear guide has a slide track. Such a linear guide configured as a slide guide can furthermore lead to advantages with regard to the production costs.

If the support profile of the support that has a metal material preferably consists of aluminum, a particularly robust refrigeration appliance can be created. Furthermore, aluminum also offers advantages with regard to its low specific gravity and its comparatively simple processing, and is also characterized by its corrosion resistance.

Cost-advantageous production and also comparatively simple installation can result if the casing of the support has a plastic material, particularly consists of it. Such a casing can, above all, also distinguish itself with regard to snap connections that might be provided. Furthermore, plastic can have a lower heat conductivity than metal, thereby making it possible to further reduce the formation of thermal poles of cold in the refrigeration appliance according to the invention.

In order to allow comparatively great overload resistance of the support, the support profile can be structured as a closed hollow profile.

BRIEF DESCRIPTION OF THE DRAWING

The object of the invention is shown in the figures, as an example, using multiple exemplary embodiments. The figures show.

WAY TO IMPLEMENT THE INVENTION

Figure 1:
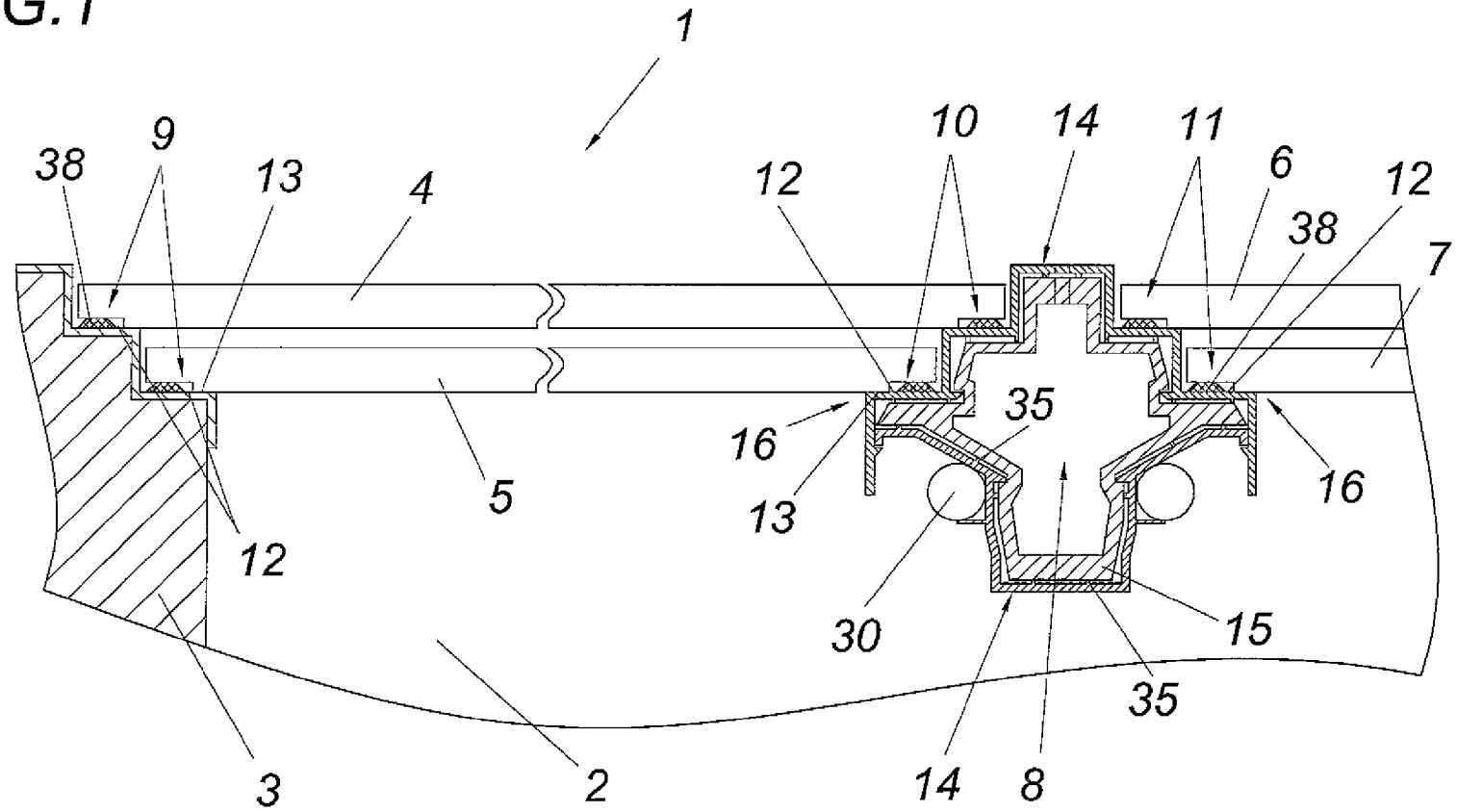
FIG. 1 a sectional view of a refrigeration appliance, shown in part.

The refrigeration appliance 1 shown as an example according to FIG. 1 has a refrigeration space 2 that serves for refrigeration, particularly for freezing of goods not shown in any detail, particularly of foods. The refrigeration space 2 is accessible from above, and enclosed laterally and at the bottom by a housing wall 3 that is shown only in part in the figures. In order to open or close the refrigeration space 2, at least in part, sliding covers 4, 5, 6, 7 are provided. These sliding covers 4, 5, 6, 7 are mounted in displaceable manner on the housing wall 3 and on a support 8, which bridges the refrigeration space 2, at least in part. The support 8 is structured as a closed hollow profile, in order to ensure great mechanical resistance. For the purpose of displaceability, the refrigeration appliance 1 has linear guides 9, 10, 11. For this purpose, the support 8 and the housing wall 3 form slide tracks 12, along which the running surfaces 13 of the sliding covers 4, 5, 6, 7, in each instance, can be displaced. The running surfaces 13, in interplay with the slide tracks 12, form the linear guides 9, 10, 11. The support 8 is formed essentially by two structural elements, a casing 14 and a support profile 15, as can particularly be seen also in FIG. 2.

The support profile 15, which consists of an aluminum material, is enclosed by a casing 14 consisting of a plastic material, and thereby completely covered or sheathed. For this reason, the casing 14 has a clearly lower heat conductivity as compared with the support profile 15, and this can reduce thermal bridges of heat or cold. Furthermore, the hollow support profile 15 shown has a comparatively great resistance moment, and therefore serves essentially for absorbing static bending stresses. In order to now also be able to allow comparatively great safety under dynamic force stresses of the sliding covers 4, 5, 6, 7, the invention proposes to have the support profile 15 run underneath the linear guide 10, 11, at least in part. In this way, great mechanical resistance of the slide tracks with regard to deformation and thereby having the sliding covers 4, 5, 6, 7 break out of the linear guides 10, 11, in each instance, can be prevented. In this way, a robust refrigeration appliance 1 can be created.

Because of the comparatively resistant support 8 or support profile 15, disadvantageous thermal bridges of cold can come about between refrigeration space 2 and the linear guide 10, 11. For this reason, icing or water accumulation must particularly be feared in the connection region 16 of the sliding cover 4, 5, 6, 7 and its linear guide 10, 11, in each instance. In order to prevent this, there is a gap 17, 18 in the region of the linear guide 10, 11, between the casing 14 and the support profile 15, which gap becomes larger at least in certain regions, and has its greatest gap width, in each instance, in the connection region between the sliding cover 4, 5, 6, 7, in each instance, and the support 8. By means of this air gap, improved heat insulation of the refrigeration space 2 can be created. The gap 17, 18 can also be filled with a heat insulator, which is not shown in any detail.

The casing 14 is structured in two parts and has two connectable profile parts 19, 20 for this purpose. In this way, sheathing of the support profile 15 can be made possible in comparatively simple manner, and this creates design simplicity. Particularly if the profile parts 19, 20 of the casing 14 are connected with one another, with shape fit, by way of two snap connections 21, 22. For this purpose, the upper profile part 19 forms resilient snap hooks 23 that engage behind a crosspiece 24 of the lower profile part 20, and thereby snaps into place.

Figure 2:
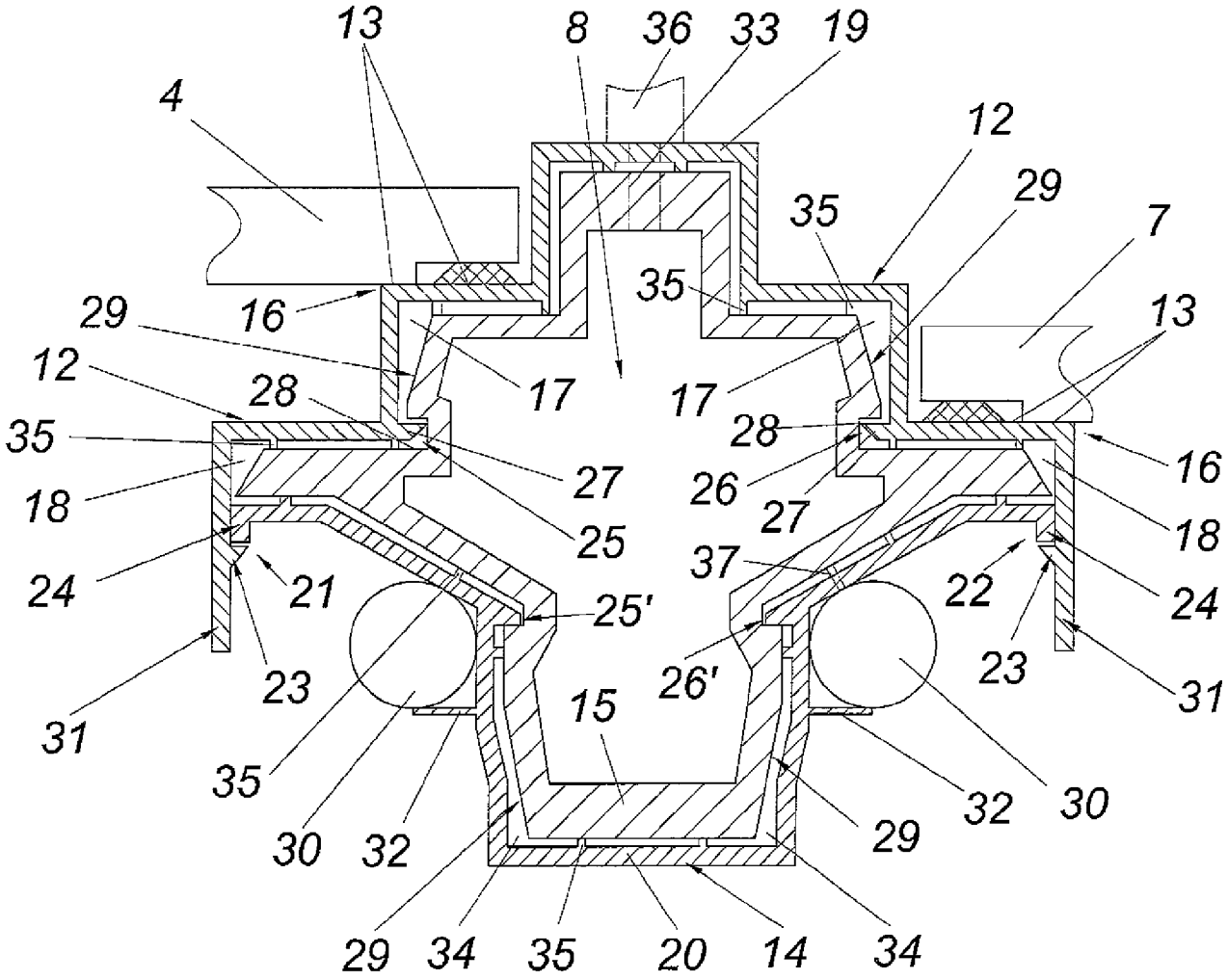
FIG. 2 an enlarged partial view of the support of the refrigeration appliance shown according to FIG. 1, FIG. 3 a three-dimensional view of the recess of the housing wall for attaching the support, and FIG. 4 an alternative embodiment of the lower profile part of the casing of the support, according to another exemplary embodiment.

As can furthermore be seen in FIG. 2, snap connections 25, 26 and 25', 26' are also provided between the casing 14 and the support profile 15, in order to thereby create shape-fit cohesion of these parts 14 and 15. For this shape-fit connection, a resilient hook 27 of the upper profile part 19 engages into a recess 28 of the support profile 15. Because the support profile 15 forms a slide surface 29 for the resilient hook 27 of the snap connection 25, 26, in each instance, which surface runs in wedge shape toward the snap connection 25, 26, in each instance, simple installation of the profile part 19 can be ensured. Furthermore, the mechanical installation stresses on the casing 14 can be kept low with these slide surfaces 29 that run in wedge shape toward the snap connection 25, 26. As can furthermore be seen in FIG. 2, snap connections 25', 26' are also provided between the lower profile part 20 and the support profile 15. Here, too, slide surfaces 29 are formed on the support profile 15, for the hooks of the profile part 20, in order to avoid abrupt deformation of the profile part 20. Both profile parts 19, 20 can thereby be securely attached to the support profile 15, in shape-maintaining manner, independent of one another. Other positions or a different number of snap connections 25, 26, 25', 26' between casing 14 and support profile 15 are possible.

The support 8 can be used in simple manner for affixing lights 30 in the refrigeration space 2. Possible disruptive glare through the sliding covers 4, 5, 6, 7 can be prevented by means of an anti-glare shield 31, which is formed using the casing 14. Simple design conditions result if the upper profile part 19 of the casing 14 forms the anti-glare shield 31, and the lower profile part 20 of the casing 14 forms a holder 32 for the lights 30. The lights 30 can be LEDs, for example. Furthermore, the holder 32 can also be configured as a snap connection, in order to thereby be able to attach the lights 30 with a simple design. However, this was not shown in any detail, for reasons of a clear illustration.

It can be seen in FIG. 1 that sliding covers 4, 5, 6, 7 are provided in the longitudinal direction of the support 8, on both sides. In this way, the refrigeration space 2 can be accessible from both longitudinal sides of the refrigeration appliance 1. The support 8 that spans the refrigeration space 2 also does not reduce the loading capacity of the refrigeration appliance 1, and therefore the invention can particularly distinguish itself as compared with refrigeration appliances in which the housing forms a center crosspiece.

As can be seen in FIG. 2, the support 8 forms an installation connector 33 between the sliding covers 4, 5 and 6, 7 on the two sides, and projects relative to the sliding covers 4, 5 and 6, 7 on the two sides. For this reason, price signs, for example, etc., can be affixed on the refrigeration appliance 1 at these locations, in easy to handle manner. Furthermore, it is possible to install a separation device or reach-in protection 36 on this connector 33, in order to prevent persons from being pinched when operating opposite sliding covers.

Furthermore, a gap 34 that is increased in width can also be provided, specifically in the bottom region of the support 8, in order to ensure improved heat insulation of the support profile 15 with regard to the cold of the refrigeration space 2.

A minimum distance of the casing 14 with regard to the support profile 15 can be guaranteed, for example, by means of spacers 35 on the casing 14 or on its profile parts 19, 20. The spacers 35 shown are merely provided as an example—changed numbers or sizes lie within the scope of the invention.

In general, it should be mentioned that the casing 14 can also have heat conduction elements 37, in order to thereby utilize the waste heat of a light 30 to heat the support profile 15. In this way, thermal bridges of cold can be even further reduced. These heat conduction elements 37 can also comprise the spacers 35, or consist of a different material than the casing 14, in order to thereby achieve an increased heat conductivity as compared with this material.

Furthermore, the sliding covers 4, 5, 6, 7 can have seals 38, in order to ensure additional sealing of the refrigeration space 2.

Figure 3:
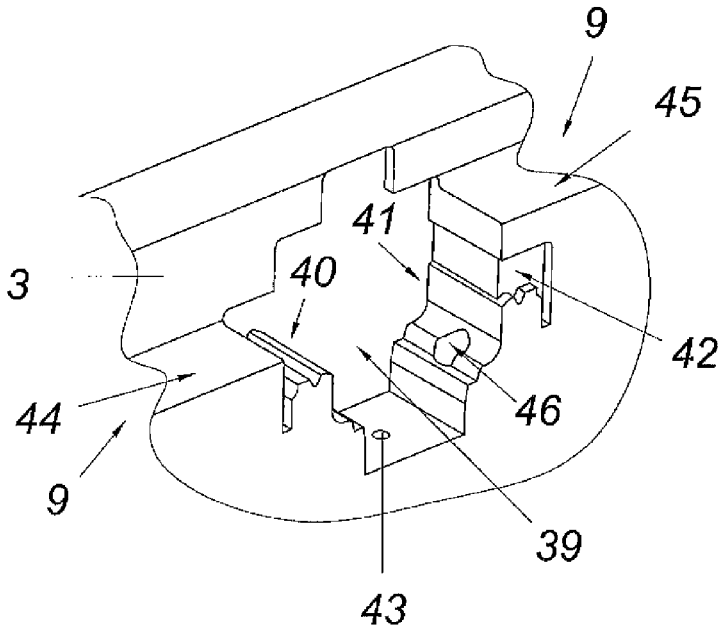

According to FIG. 3, a housing recess 39 can be seen in the housing wall 3 of the refrigeration appliance 1, which wall is shown in part, into which recess the support 8 can be inserted with shape fit. It can be clearly seen that the housing recess 39 is adapted to the casing 14 of the support profile 15.

However, the housing recess 39 is structured differently with regard to its broad sides 40, 41. Thus, the broad side 41, in contrast to the broad side 40, has a wall continuation 42 that projects in the direction of the support 8, and also lies above the support 8, in part. For this purpose, the support 8 is also structured to be shortened in this region, thereby forming a step-shaped progression on its face sides. As a result, the support 8 can be pushed into the housing recess 39, whereby securing of the support 8 on the refrigeration appliance 1 is achieved by means of its shape fit with the housing recess 39. Furthermore, a cable conduit 46 is situated in this region of the housing wall 3. Because of the support 8, which is shortened here, as mentioned above, cables, etc., can be introduced into the support 8, in installation-friendly manner. The cable conduit 46 is sealed, in order to thereby create thermal insulation of the support 8 with regard to the housing wall 3, for example. In addition, the support 8 is firmly connected with the housing wall 3 by means of a screw connection, not shown in any detail. The housing bore 43 provided for this purpose can be seen in FIG. 3, according to which the guide tracks 44, 45 of the linear guides 9 of the housing wall 3, which run one on top of the other, can also be seen.

Figure 4:
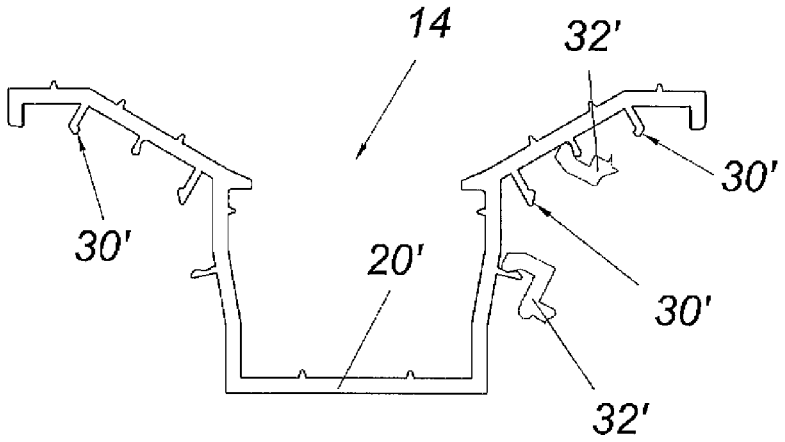

According to FIG. 4, an alternative embodiment of the lower profile part 20' of the casing 14, which is otherwise not shown in any detail, is shown according to another exemplary embodiment. This profile part 20 shows a design modification in the holder 32' for a light 30', shown in part, structured as a snap connection.

The invention claimed is:

1. Refrigeration appliance for refrigerated goods, the refrigeration appliance:

having a refrigeration space, having a housing wall that delimits the refrigeration space at least in part, having a support that bridges the refrigeration space at least in certain regions, which support has a casing for heat insulation and a support profile surrounded by the casing to absorb bending stresses, having linear guides, and having at least one sliding cover capable of closing off the refrigeration space, at least in part, and mounted so as to be displaceable on the casing of the support and on the housing wall, by way of the linear guides, wherein the support profile runs underneath the linear guide, at least in part, wherein the casing comprises at least one snap connection comprising a resilient hook and is connected with the support profile, with shape fit, by way of the at least one snap connection, and wherein the support profile forms a slide surface for the resilient hook of the at least one snap connection of the casing, the slide surface running toward the at least one snap connection.

2. Refrigeration appliance according to claim 1, wherein at least one gap increases in size at least in certain regions and is provided in a region of the linear guides between the casing and the support profile.

3. Refrigeration appliance according to claim 2, wherein the gap increases in size, in such a manner that improved thermal separation of the support from the casing is created, in order to prevent thermal poles of cold in the connection region of the sliding cover to the support.

4. Refrigeration appliance according to claim 1, wherein the casing that sheathes the support profile has at least two profile parts that can be connected with one another.

5. Refrigeration appliance according to claim 4, wherein the profile parts of the casing are connected with one another with shape fit, by way of at least one snap connection.

6. Refrigeration appliance according to claim 5, wherein the at least one snap connection has a snap hook.

7. Refrigeration appliance according to claim 1, wherein the casing forms an anti-glare shield for a light attached to the support.

8. Refrigeration appliance according to claim 7, wherein the upper profile part of the casing forms the anti-glare shield, and the lower profile part of the casing forms the holder for the light.

9. Refrigeration appliance according to claim 1, wherein sliding covers are provided in the longitudinal direction of the support, on both sides.

10. Refrigeration appliance according to claim 9, wherein the support forms installation connectors in the region between the sliding covers on both sides.

11. Refrigeration appliance according to claim 10, wherein the support projects beyond the sliding covers on both sides.

12. Refrigeration appliance according to claim 1, wherein the linear guide has a slide track.

13. Refrigeration appliance according to claim 1, wherein a support profile of the support is made of a metal material.

14. Refrigeration appliance according to claim 1, wherein the casing of the support has a plastic material.

15. Refrigeration appliance according to claim 1, wherein the support profile is structured as a closed hollow profile.

16. Refrigeration appliance according to claim 1, wherein the refrigerated good are frozen goods.

17. Refrigeration appliance according to claim 1, wherein the material comprises aluminum.

18. Refrigeration appliance according to claim 1, wherein the casing of the support consists of a plastic material.

19. Refrigeration appliance according to claim 1, wherein the support profile comprises a plurality of lateral protrusions, a downward protrusion, and a plurality of upward protrusions, wherein the casing comprises a plurality of recesses configured to receive the protrusions with shape fit, and wherein each protrusion of the plurality of lateral protrusions, of the downward protrusion, and of the plurality of upward protrusion is received in a respective recess of the plurality of recesses.

* * * * *